US009353582B2

(12) United States Patent
De Mul et al.

(10) Patent No.: US 9,353,582 B2
(45) Date of Patent: May 31, 2016

(54) WELL DRILLING TUBULARS BIN SYSTEM, AND METHOD FOR USE OF SYSTEM

(71) Applicant: ITREC B.V., Schiedam (NL)

(72) Inventors: Arthur Alexander De Mul, Dordrecht (NL); Diederick Bernardus Wijning, Schiedam (NL); Joop Roodenburg, Delft (NL)

(73) Assignee: ITREC B.V., Schiedam (NL)

( * ) Notice: Subject to any disclaimer, the term of this patent is extended or adjusted under 35 U.S.C. 154(b) by 53 days.

(21) Appl. No.: 14/372,865

(22) PCT Filed: Jan. 18, 2013

(86) PCT No.: PCT/NL2013/050028
§ 371 (c)(1),
(2) Date: Jul. 17, 2014

(87) PCT Pub. No.: WO2013/109148
PCT Pub. Date: Jul. 25, 2013

(65) Prior Publication Data

US 2014/0353038 A1 Dec. 4, 2014

(30) Foreign Application Priority Data

Jan. 18, 2012 (NL) ..... 2008134

(51) Int. Cl.
*B66F 7/10* (2006.01)
*B66F 7/20* (2006.01)

(Continued)

(52) U.S. Cl.
CPC ..... *E21B 19/08* (2013.01); *B66F 7/0641* (2013.01); *B66F 7/08* (2013.01); *C21B 7/14* (2013.01); *E21B 19/15* (2013.01); *F27B 1/21* (2013.01); *F27D 3/12* (2013.01); *F27D 3/145* (2013.01)

(58) Field of Classification Search
CPC ..... E21B 19/155; E21B 19/15; E21B 19/20; E21B 17/006; E21B 19/00; E21B 19/08; E21B 19/14; E21B 7/02; E21B 19/22; B60P 7/12; B65D 2590/005; B65D 2590/0058; B65D 88/022; B65D 88/129; B65D 90/006; B65G 1/04
USPC ..... 187/211, 215; 211/70.4; 254/122, 123, 254/124; 414/12, 22.51–22.59, 414/22.61–22.66, 427, 589, 414, 421, 590, 414/745.1, 746.4, 796.7; 182/141, 149, 182/69.5; 451/333
See application file for complete search history.

(56) References Cited

U.S. PATENT DOCUMENTS 3,093,251 A 6/1963 Bender
3,254,776 A * 6/1966 Brown ..... B65G 1/08 193/17

(Continued)

FOREIGN PATENT DOCUMENTS

CA 1 170 220 A 7/1984
CA 1247590 A1 * 12/1988 ..... E21B 19/15
JP 08189278 A * 7/1996

*Primary Examiner* — Gregory Adams
(74) *Attorney, Agent, or Firm* — Birch, Stewart, Kolasch & Birch, LLP

(57) ABSTRACT

A well drilling tubulars bin system comprises a well drilling tubulars bin and control device. The bin comprises a frame structure, and an elevator mechanism, for holding multiple layers of a plurality of well drilling tubulars. The elevator mechanism comprises a liftable support structure, and a left and right hydraulic cylinder. The support structure is liftable from a lower position to an upper position. The support structure is raised and lowered in a level manner, or with a tilt angle. The elevator mechanism comprises a first left lift arm and a first right lift arm. The first left and right lift arms are at a first end rotatably connected to the support structure, and at a second end opposite from the first end rotatably connected to the frame structure. The left and right hydraulic cylinders are connected to the respective lift arms for rotating the respective lift arm.

16 Claims, 5 Drawing Sheets

(51) Int. Cl.

| | |
|---|---|
| ***E21B 19/08*** | (2006.01) |
| ***C21B 7/14*** | (2006.01) |
| ***B66F 7/08*** | (2006.01) |
| ***F27B 1/21*** | (2006.01) |
| ***B66F 7/06*** | (2006.01) |
| ***F27D 3/14*** | (2006.01) |
| ***F27D 3/12*** | (2006.01) |
| ***E21B 19/15*** | (2006.01) |

(56) References Cited

U.S. PATENT DOCUMENTS 3,365,085 A * 1/1968 Wilson ..... B60P 3/41 414/471
4,051,956 A 10/1977 Teague
4,522,548 A * 6/1985 Oswald ..... B60P 3/00 254/8 C
6,164,883 A * 12/2000 Wilcox ..... B65G 1/0442 410/32
6,311,788 B1 * 11/2001 Weixler ..... E21B 19/15 166/77.51
7,134,829 B2 * 11/2006 Quenzi ..... B60P 1/02 180/24.01
2003/0196791 A1 * 10/2003 Dunn ..... E21B 19/155 166/77.51
2008/0101891 A1 * 5/2008 Belik ..... E21B 19/15 414/22.57
2009/0263221 A1 * 10/2009 Oldershaw ..... E21B 19/15 414/495
2010/0150685 A1 * 6/2010 Sawyer ..... E21B 19/15 414/22.62

* cited by examiner 16
18
28
92
1
18
50,52
36
16
64
54,56
VII
70
22
4
62
46,48
34
2
42,44
60
20,82
14
92
10
8
6

92
1
20
92

30
92
1
60
20
92

WELL DRILLING TUBULARS BIN SYSTEM, AND METHOD FOR USE OF SYSTEM

The invention relates to a well drilling tubulars bin system. Such a well drilling tubulars bin system is used for the transport and storage of drilling tubulars, such as drill pipe, casing, and other drill tubing, which are used for drilling wells, such as oil wells, natural gas wells, water wells, and geothermal wells.

U.S. Pat. No. 3,093,251 discloses a power operated pipe bin. The pipe bin is used for the storage, transportation, and manipulation of elongate metal stock, particularly pipe sections used in oil well drilling operations. The pipe bin comprises a base unit, made of I-beams, H-beams, and tubular members, as well as three main uprights and two corner posts on each side. The main uprights are provided with slots in their upper ends to accommodate I-beams which may be laid in place for rolling pipe across the top of an idle bin to and from a rig platform walkway. A top siderail is made up at each side of the bin with tubular sections welded to and joining the main columns, and the corner posts. An elevator mechanism of the pipe bin comprises two support cross members, cables, sheaves, and a hydraulic system. The sheaves are carried on the outer pairs of the main uprights.

The two support cross members of U.S. Pat. No. 3,093,251 are suspended from the cable ends below the respective pairs of sheaves. The cables run from the cross members, over the sheaves, to the plungers of a pair of hydraulic cylinders detachably mounted atop the corner posts at the right end of the bin and aligned with the respective siderails. The hydraulic system further comprises a sensing equalizer including a shunted system of two needle choke valves. The hydraulic equalizer guarantees a level condition of a stock being manipulated in the bin, and may also be employed to deliberately tilt the support cross members to assist in rolling the pipe either into or out of the bin.

During loading of the bin of U.S. Pat. No. 3,093,251, the support cross members are raised by the hydraulic system until their upper flanges are level with the tops of the main columns, or slightly below this level. The pipe sections are then rolled onto the support cross members until the bottom layer is complete. With the bottom layer in place, cross rails of metal or wood may be laid in place across the pipe as spacers to provide a rolling surface for the second layer of pipe. The hydraulic system is actuated to bring the top surface of the cross rails level with the bin columns. The second layer of pipe is then rolled into place on the rails, and the process of laying rails and lowering is repeated until the bin is loaded.

For unloading of the bin of U.S. Pat. No. 3,093,251 the process is reversed. Dispensing from the bin is effected by actuating the hydraulic cylinder in a sense to eject the plunger. The resultant pull of the cables on support cross members raises the entire contents of the bin until the uppermost layer of pipe is positioned for rolling across the tops of the bin columns. With the uppermost row of pipe removed, the loose cross rails are removed and the contents again raised to bring the next layer of pipe into position for removal. Assuming the first bin emptied the I-beams are placed in the slots in the upper ends of the main uprights to render the empty bin a rolling platform for dispensing from the second or succeeding bins.

Well drilling tubular bins are commonly employed in harsh conditions, e.g. in desert like regions (or in general in environments with much sand, gravel, dust, etc.), at extreme high or low temperatures or other adverse weather conditions, etc. Also high demands are placed on the reliability and operating safety of such bins. It has been found that existing drilling tubular bin designs are not satisfactory in view of these demands. For example cables and sheaves are prone to significant wear in the envisaged operating environment of these bins, which may cause failure at an undesirable rate and may even form a safety risk as a worn cable may snap.

It is an object of the invention to solve the disadvantage of the prior art, or at least provide an alternative. In particular, it is an object to provide a well drilling tubulars bin system which is more reliable that of the prior art whilst allowing for safe operation.

The invention achieves this object by providing a well drilling tubulars bin system as defined by claim 1, and a method as defined by claim 15.

Advantageous embodiments are defined in the dependent claims.

A well drilling tubulars bin system of the invention comprises a well drilling tubulars bin and control device. The well drilling tubulars bin comprises a frame structure and an elevator mechanism for holding and lifting multiple layers of well drilling tubulars, each layer comprising multiple tubulars side by side.

The frame structure comprises a bottom frame, a left side frame fixed to the bottom frame, and a right side frame fixed to the bottom frame, the left side frame and the right side frame being of the same height. Preferably the frame structure is provided with ISO-standard container corner fittings, most preferably as in a 40 ft (12.19 m) ISO container, to allow for efficient handling and transportation of the bin, either loaded or empty. Preferably the bin has a width of 8 feet (2.44 m). In a possible design with open ends the bin may be loaded with tubulars having a length greater than 40 ft. In another design the ends of the bin are closed.

The elevator mechanism comprises a liftable support structure, a left hydraulic cylinder, and a right hydraulic cylinder. The liftable support structure defines a support plane for supporting the well drilling tubulars, which support structure is liftable—whilst supporting the well drilling tubulars—from a lower position wherein the support plane is below half the height of the side frames to an upper position wherein the support plane is at least equal to a top part of one of the side frames.

The control device is arranged and embodied for actuating the left and right hydraulic cylinder such that the liftable support structure is raised and lowered in a level manner, and for actuating the left and right hydraulic cylinder such that the liftable support structure obtains a tilt angle with respect to a horizontal plane towards one of the left and the right side frame.

The elevator mechanism further comprises a first left lift arm and a first right lift arm, that are rotatable in a vertical plane, preferably each lift arm moving close along the inside of the respective side frame of the bin.

The first left lift arm at a first end is rotatably connected to the liftable support structure with a first left support structure pivot, and at a second end opposite from the first end is rotatably connected to the frame structure with a first left frame structure pivot. The first right lift arm is at a first end rotatably connected to the liftable support structure with a first right support structure pivot, and is at a second end opposite from the first end rotatably connected to the frame structure with a first right frame structure pivot, such that rotating the first left lift arm and the first right lift arm results in lifting, lowering, or tilting of the liftable support structure. The left hydraulic cylinder is connected to the first left lift arm for rotating the first left lift arm. The right hydraulic cylinder is connected to the first right lift arm for rotating the right lift arm.

By activating the hydraulic cylinders, the respective lift arms are rotated and either lift or lower the respective side of the liftable support structure. Lift arms are more robust than cables and the damage which results from failure of a lift arm is less than that of a snapping cable. Surprisingly, lift arms which are actuated by individual hydraulic cylinders are still capable of tilting the liftable support structure by rotating the lift arms to a different angle.

It is noted that CA-1.170.220 discloses a container for heavy elongated cylindrical articles. The container has an elongated base for supporting the articles, side walls on opposite sides of the base for retaining the articles thereon, and a lifting assembly adjacent each end of the base. Each lifting assembly has two two-arm levers pivotally connected to the base at the junction of the two arms for pivotal movement in a vertical plane about an axis extending transversely to the base. The levers have a first arm positionable in the plane of the base below pipes stored in the container. Each first arm has a free end remote from the arm junction. A transversely extending pipe lifting member extends between the respective free ends of the first arms, across the base below the pipes. Each lever also has a second arm extending upwardly from the arm junction. A transverse member connects the free ends of the second arms. A power operated device is connected between each second arm and a part of the container for pivoting the second arms downwardly towards the base with consequent pivotal movement of the first arms upwardly from the base to cause the transverse pipe lifting member to lift the portions of the pipes at the relevant end of the container to a height higher than that of the side walls. The transversely extending pipe lifting member and the transverse member ensure that the levers rotate simultaneously, so that the transversely extending pipe lifting member remains level. Thus, the pipes are manually rolled from the container. This is in contrast with the current invention, wherein the liftable support structure obtains a tilt angle with respect to a horizontal plane towards either the left or the right side frame, so that the pipes roll out of the bin due to the gravity.

In particular, the first left support structure pivot and the first right support structure pivot each allows rotation around at least two different axes of rotation. This is a compact solution to provide not only for the lift arms to rotate with respect to the support structure, but also allows the support structure to tilt with respect to the lift arms. In an alternative, there are separate pivots with each one rotational axis.

In an embodiment, the first left support structure pivot and the first right support structure pivot each allows translational movement between the support structure and the respective first end of the first left lift arm, respectively first right lift arm. In this way, the rotating movement of the first left lift arm is converted into a vertical linear movement of the support structure.

In an embodiment, the first left frame structure pivot and the first right frame structure pivot define each one rotational axis which is fixed with respect to the frame structure and to the respective lift arm.

In an embodiment, the elevator mechanism further comprises a first left actuator arm which is fixedly connected to the first left lift arm for joint rotation of the first left actuator arm and the first left lift arm around the first left frame structure pivot, and the left hydraulic cylinder is connected to the first lift arm via the first actuator arm at an end of the first actuator arm which is distal with respect to the first left frame structure pivot. Having a separate actuator arm allows to optimise the position and orientation of the hydraulic cylinder independent of that of the lift arm.

Preferably, the first left actuator arm and the left hydraulic cylinder are provided in the left side frame. This results in a compact structure, wherein as much of the available height and width of the well drilling tubulars bin is available for storing well drilling tubulars.

In an embodiment, the elevator mechanism further comprises a second left lift arm, a second left actuator arm, and a second left frame structure pivot, wherein the second left actuator arm is fixedly connected to the second left lift arm for joint rotation around the second left frame structure pivot for lifting the liftable support structure, and the left hydraulic cylinder extends from the first end of the first left actuator arm to a first end of the second left actuator arm. Having second left lift and actuator arms allows for a stable support, as well as lifting and lowering, of the support structure.

Preferably, the elevator mechanism further comprises a left stabilising rod which extends from the first left actuator arm to the second left actuator arm. The left stabilising rod is rotatably connected to the first left actuator arm at a point on the first left actuator arm located at a distance d from the first left frame structure pivot away from the first end of the first left actuator arm, and the left stabilising rod is rotatably connected to the second left actuator arm at a point on the second left actuator arm located at the same distance d from the second frame structure pivot towards the first end of the second left actuator arm. The stabilising rod is a simple solution to ensure equal rotation of the first and second left lift arms.

In an embodiment, the liftable support structure comprises a left longitudinal beam, a right longitudinal beam, and at least two cross beams, which at least cross beams extend between, and are connected to, the left and right longitudinal beams. The left longitudinal beam is provided with the first left support structure pivot, and the right longitudinal beam is provided with the first right support structure pivot.

In an embodiment, the liftable support structure comprises at least two struts which are held in one of the left and right side frame, and are movable from a retracted position wherein the at least two struts do not extend above the respective side frame to at least one raised position, wherein the at least two struts extend partly above the respective side frame. These struts prevent well drilling tubulars from rolling out of the well drilling tubulars bin at the wrong side of the bin, when the bin is being loaded with well drilling tubulars, or when the liftable support structure is being lifted and/or tilted.

In an embodiment, the well drilling tubulars bin system comprises at least two well drilling tubulars bins, and at least two slide bars which are at their respective ends connectable to the at least two well drilling tubulars bins for providing a roll structure for well drilling tubulars from one well drilling tubulars bin to another well drilling tubulars bin. By coupling at least two well drilling tubulars bins with slide bars the storage capacity of the system can be increased in a flexible manner.

Preferably, the slide bars are connectable to a top portion of the struts. This is efficient, as the struts may perform multiple functions. By raising or lowering the struts, the angle of the attached slide bar can be changed to a preferred value.

The control device preferably includes one or more hydraulic pumps, preferably electrically operable but possibly manually operated. Said one or more pumps may be arranged on the bin itself, but preferably are detached from the bin to be arranged at a remote location, e.g. as part of a hydraulic unit associated with a drilling rig. A connection between the one or more remote pumps and the hydraulic cylinders on the bin preferably is established by hydraulic hoses provided with quick-connectors that include an automatic valve that opens upon establishing the connection and closes upon disconnection.

In an embodiment, at least part of the control device is located at a position remote from the well drilling tubulars bin, e.g. the pump being in a hydraulic unit of the drilling rig.

In an embodiment control of the operation of the bin is performed from a remote control cabin, e.g. the drilling rig control cabin wherein also controls for the drilling process are present. This enables controlling the loading and/or unloading of the well drilling tubulars bin from a safe location, as the well drilling tubulars are quite heavy and a collision between these and an operating person should be avoided.

Preferably, the control device is electronically connected to the control unit of a pipe loader. This enables automated control of the well drilling tubulars bin system.

In an embodiment, the well drilling tubulars bin system comprises at least one weight sensor for determining the total weight of the well drilling tubulars in the well drilling tubulars bin. This enables controlling the total weight in the well drilling tubulars bin during loading, to avoid overloading.

The frame structure is embodied, as is preferred, with dimensions so as to allow transportation thereof as a 40 ft ISO container, with ISO corner fittings on the corners of the bottom frame 8.

The system may e.g. be used in combination with a modular drilling rig system, e.g. as disclosed in U.S. Pat. No. 7,255,180.

The invention will be illustrated by an exemplary embodiment, which is shown in the figures, in which.

Figure 1:
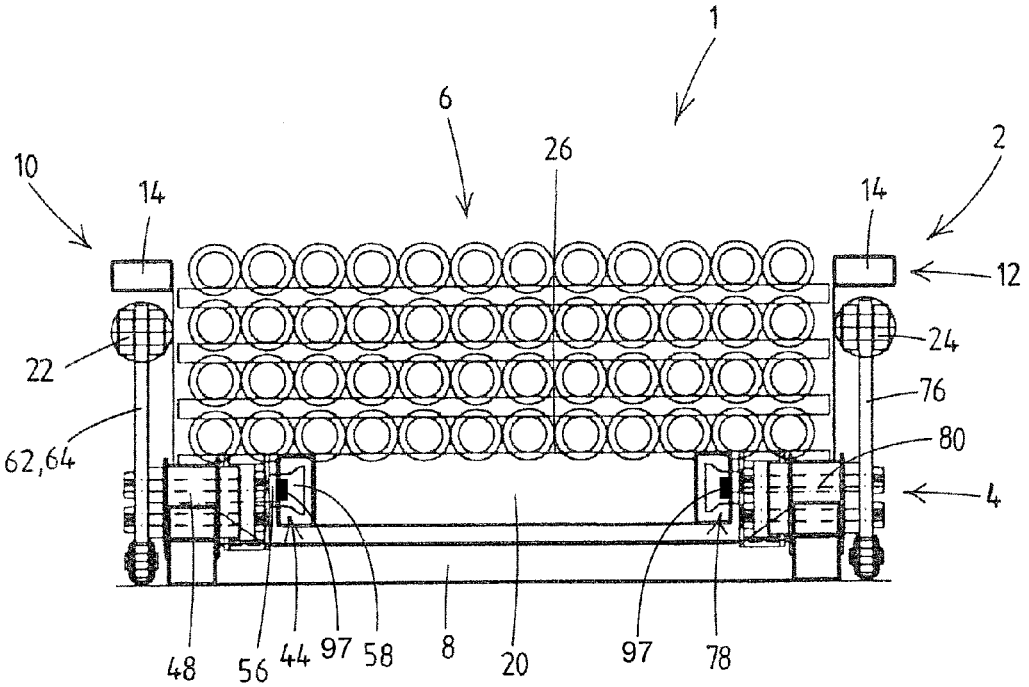
FIG. 1 shows a cross section through an example of a well drilling tubulars bin according to the invention.

A well drilling tubulars bin system comprises a well drilling tubulars bin, which is denoted in its entirety with reference number 1, and control device (not shown). The well drilling tubulars bin 1 comprises a frame structure 2, and an elevator mechanism 4, for holding and lifting multiple layers of well drilling tubulars 6, each layer comprising a plurality of well drilling tubulars 6.

The well drilling tubulars 6 may be any elongated tubular material used for well drilling, such as drill pipe, casing, and tubing. Typical well drilling tubulars for this embodiment may have diameters ranging from 8.9 centimeter to 14 centimeter (3.5" to 5.5").

The frame structure 2 comprises a bottom frame 8, a left side frame 10 fixed to the bottom frame 8, and a right side frame 12 fixed to the bottom frame 8. The left side frame 10 and the right side frame 12 are of the same height. Each side frame is made of longitudinal top steel beams 14, vertical steel beams 16, and diagonal steel beams 18, which are welded together, and to the steel bottom frame 8.

The frame structure is embodied, as is preferred, with dimensions so as to allow transportation thereof as a 40 ft ISO container, with ISO corner fittings on the corners of the bottom frame 8. Additionally, as is preferred, ISO corner fittings are present on the top corners of the side frames, e.g. allowing for stacked transportation of two bins on top of one another.

The elevator mechanism 4 comprises a liftable support structure 20, a left hydraulic cylinder 22, and a right hydraulic cylinder 24, wherein the liftable support structure 20 defines a support plane 26 for supporting the well drilling tubulars 6.

Figure 2:
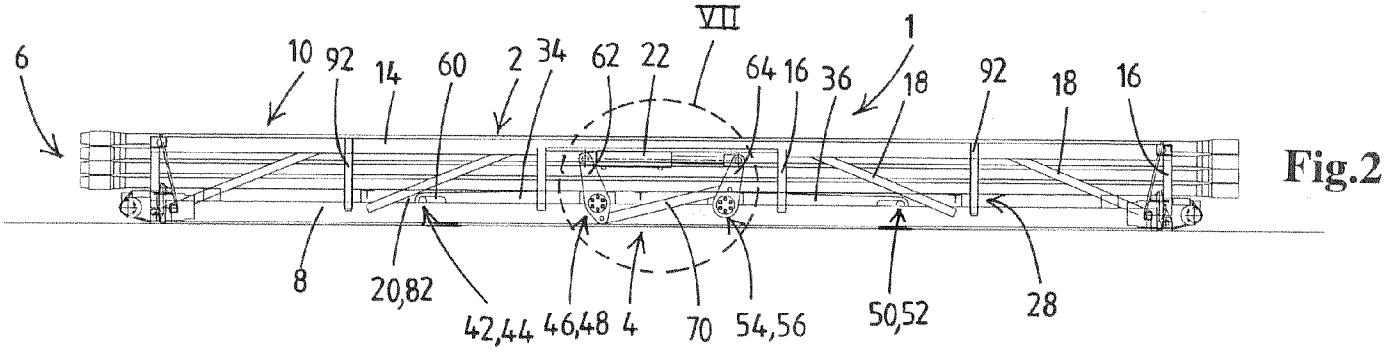
FIG. 2 shows a longitudinal view of the well drilling tubulars bin of FIG. 1 with a liftable support structure in a lower position.
Figure 3:
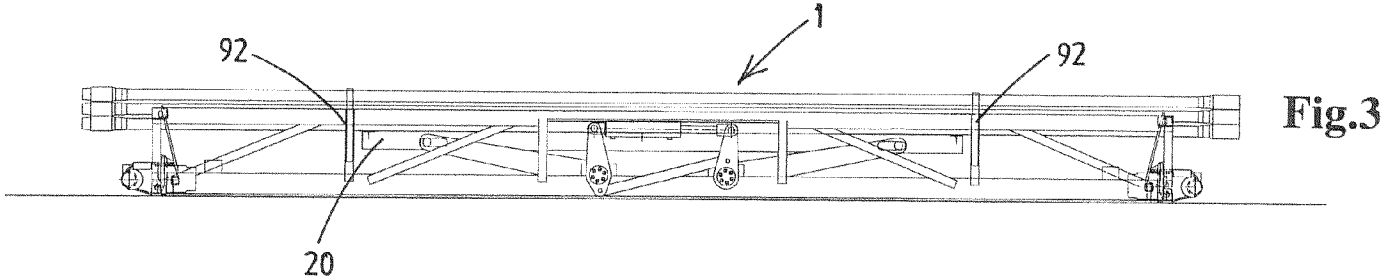
FIG. 3 shows the view of FIG. 2, with the liftable support structure in an intermediate position.
Figure 4:
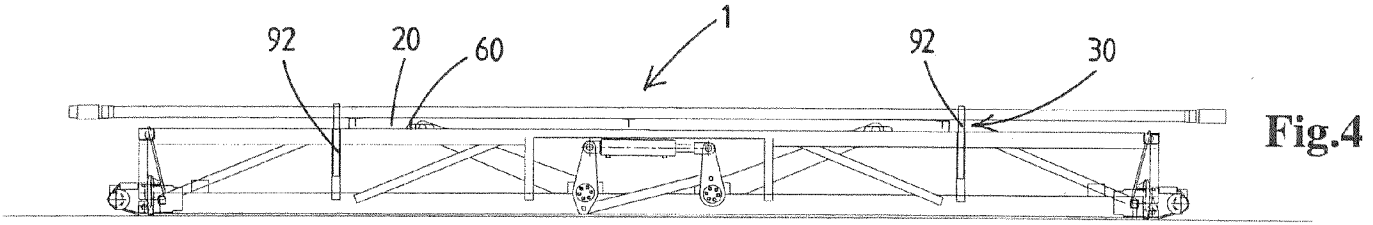
FIG. 4 shows the view of FIG. 2, with the liftable support structure in an upper position.

The support structure 20 is liftable from a lower position 28 wherein the support plane is below half the height of the side frames (FIG. 2), to an upper position 30 wherein the support plane is at least equal to, and in this embodiment at least 25 centimeter above, preferably 40 centimeter above a top part of one of the side frames (FIG. 3). The support structure 20 is also liftable to positions between the lower position 28 and the upper position, such as an intermediate position 31 (FIG. 3).

The control device includes at least one hydraulic pump, which may be a hydraulic pump in a hydraulic system of a drilling rig (not shown). The elevator mechanism 4 has a hydraulic connection (not shown), e.g. a quick connector, for connecting the elevator mechanism to the hydraulic system. The control device may further include one or more valves, for example remote operated valves (not shown).

The control device is arranged for actuating the left 22 and right 24 hydraulic cylinder such that the liftable support structure 20 is raised and lowered in a level manner. The control device can also actuate the left and right hydraulic cylinder differently, such that the liftable support structure obtains a tilt angle with respect to a horizontal plane towards one of the left and the right side frame. The control device may include an electronic control unit which is located at a control cabin from where a pipe feeding operation is controlled. A pipe loader 32 (FIG. 5) may also be controlled from the control cabin, and preferably the electronic control unit is electronically connected, in the case integrated with, the control unit of the pipe loader 32, which may be further integrated with the control unit of a complete drilling rig.

The elevator mechanism 4 further comprises a first 34 and a second 36 left lift arm, as well as a first 38 and a second 40 right lift arm. The first left lift arm 34 is at a first end 42 rotatably connected to the liftable support structure 4 with a first left support structure pivot 44. The first left lift arm 34 is at a second end 46 opposite from the first end 42 rotatably connected to the frame structure 4 with a first left support structure pivot 48. The second left lift arm 36 is at a first end 50 rotatably connected to the liftable support structure 4 with a second left support structure pivot 52. The second left lift arm 36 is at a second end 54 opposite from the first end 50 rotatably connected to the frame structure 4 with a second left frame structure pivot 56.

The first 44 and second 52 left support structure pivot are each made of a pivot pin 56, with a reverse conical pivot pin head 58 attached to the respective left lift arm 34, 36, and an elongated pin hole 60 in the liftable support structure 20. This arrangement allows rotation around three different axes of rotation, as well as a translational movement between the liftable support structure 20 and first 34 and second 36 left lift arm.

The first and second left frame structure pivot 48, 56 each define one rotational axis which is fixed with respect to the frame structure 2 and to the respective lift arm 34, 36.

The elevator mechanism 4 further comprises a first and second left actuator arm 62, 64 which are fixedly connected to the first left lift arm 34, respectively the second left lift arm 36, for joint rotation of the first left actuator arm 62 and the first left lift arm 34 around the first left frame structure pivot 48, and for joint rotation of the second left actuator arm 64 and the second left lift arm 36 around the second left frame structure pivot 56.

The left hydraulic cylinder 22 is connected to the first lift arm 34 via the first actuator arm 62 at an end 66 of the first actuator arm 62 which is distal with respect to the first left frame structure pivot 48. The left hydraulic cylinder 22 is also connected to the second lift arm 36 via the second actuator arm 64 at an end 68 of the first actuator arm 64 which is distal with respect to the second left frame structure pivot 56. Accordingly, the left hydraulic cylinder 22 actuates both left lift arms 34, 36 via the respective first actuator arms 62, 64. The first left actuator arm 62 and the left hydraulic cylinder 22 are provided in the left side frame 10. The first and the second left frame structure pivot 48, 56, as well as the left lifting arms 34, 36, extend under the support plane 26.

The elevator mechanism 4 further comprises a left stabilising rod 70 which extends from the first left actuator arm 62 to the second left actuator arm 64. The left stabilising rod 70 is rotatably connected to the first left actuator arm 62 at a point 72 on the first left actuator arm 62 located at a distance d from the first left frame structure pivot 48 away from the first end 66 of the first left actuator arm 62, and the left stabilising rod 70 is rotatably connected to the second left actuator arm 64 at a point 74 on the second left actuator arm 64 located at the same distance d from the second frame structure pivot 56 towards the first end 68 of the second left actuator arm 64.

The elevator mechanism 4 comprises at the right side of the well drilling tubulars bin 1 arms and pivots in a similar, identical, or mirrored fashion compared to those on the left side as described above. Some of these elements, such as the first right lift arm 38, the right hydraulic cylinder 24 a first right actuator arm 76, a first right support structure pivot 78, and a first right frame structure pivot 80 are visible in the cross sections of FIGS. 1, 5, and 6. These arms and pivots on the right side cooperate in the same manner as on the left side for lifting and lowering the right side of the liftable support structure 20. Insofar the liftable support structure 20 is lifted or lowered at both sides to the same level, the liftable support structure 20 remains level, i.e. parallel to a horizontal plane. If the left hydraulic actuator 22 rotates the left support structure pivot 44 to a lower level than the hydraulic actuator 24 rotates the right support structure pivot 78, then the liftable support structure 20 tilts sideways to the left side of the well drilling tubulars bin 1, and vice versa.

Figure 8:
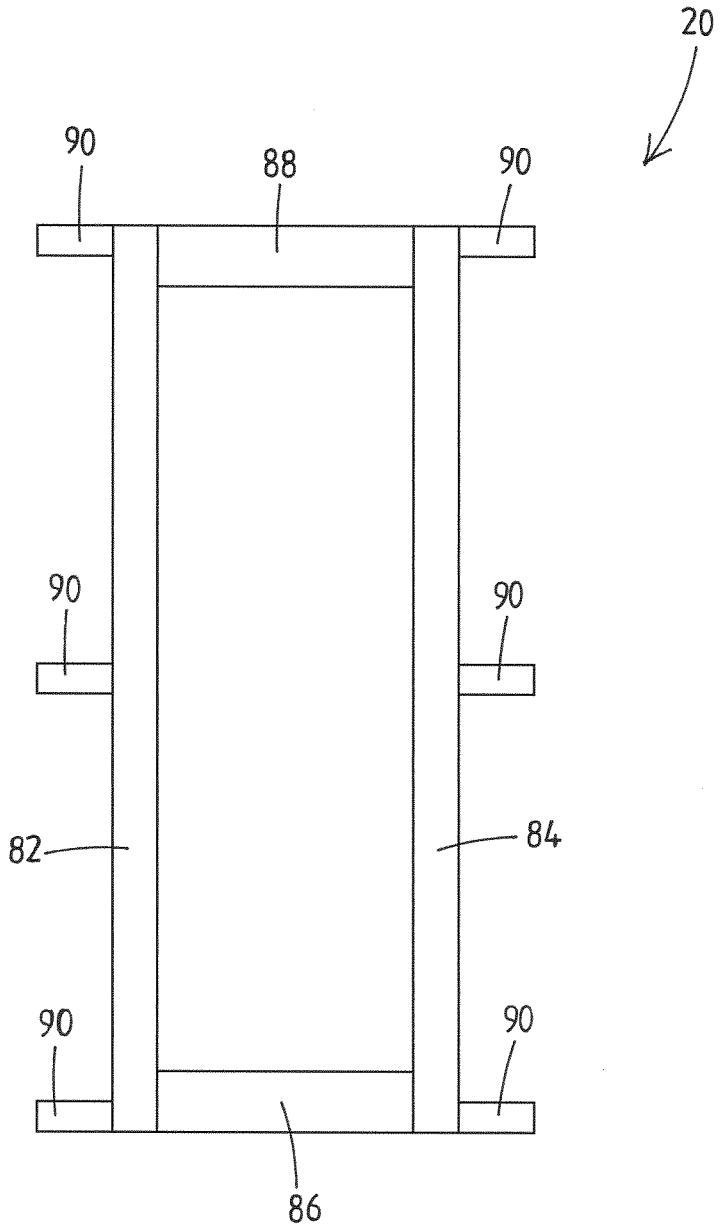
FIG. 8 shows an example of a liftable support structure.

The liftable support structure 20 comprises a left longitudinal beam 82, a right longitudinal beam 84, and at least two cross beams 86, 88, which at least two cross beams 86, 88 extend between, and are welded to, the left and right longitudinal beams 82, 84 (FIG. 8). The liftable support structure 20 further comprises brackets 90 which enlarge the width of the support plane 26. The left longitudinal beam 82 is provided with the first left support structure pivot 44, and the second left support structure pivot 52. The right longitudinal beam 84 is provided with the first right support structure pivot 78, and the second right support structure pivot (not visible).

Two struts 92 are held in each of the left 10 and right 12 side frame, and are movable from a retracted position wherein the at least two struts do not extend above the respective side frame (see FIG. 2) to at least one raised position, wherein the at least two struts 92 extend partly above the respective side frame (FIGS. 3-6).

The well drilling tubulars bin system comprises weight sensors 97 for determining the total weight of the well drilling tubulars in the well drilling tubulars bin. The weight sensors 97 are in this case provided at the support structure pivots 44, 52, 78.

Figure 5:
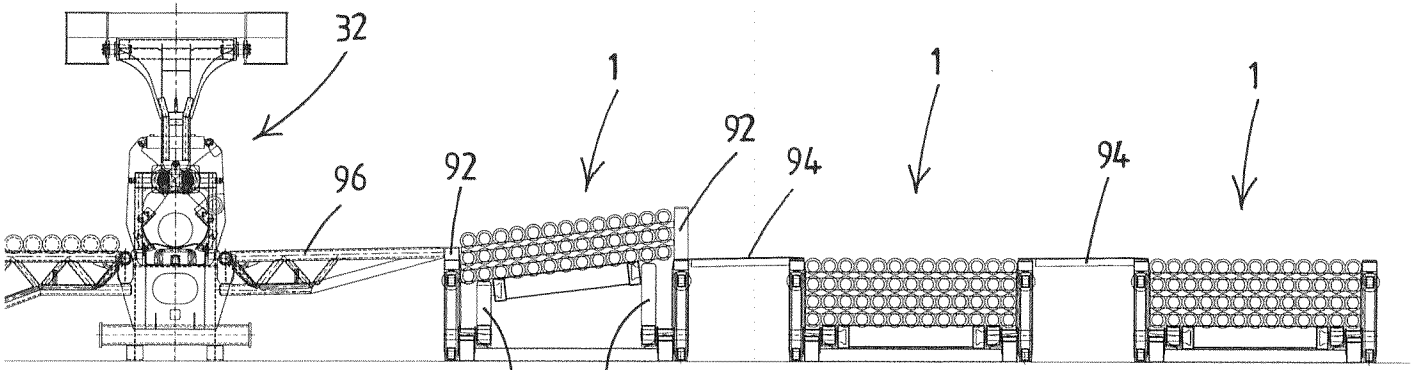
FIG. 5 shows a cross section of a system well drilling tubulars bin system according to the invention with three well drilling tubulars bins.
Figure 6:
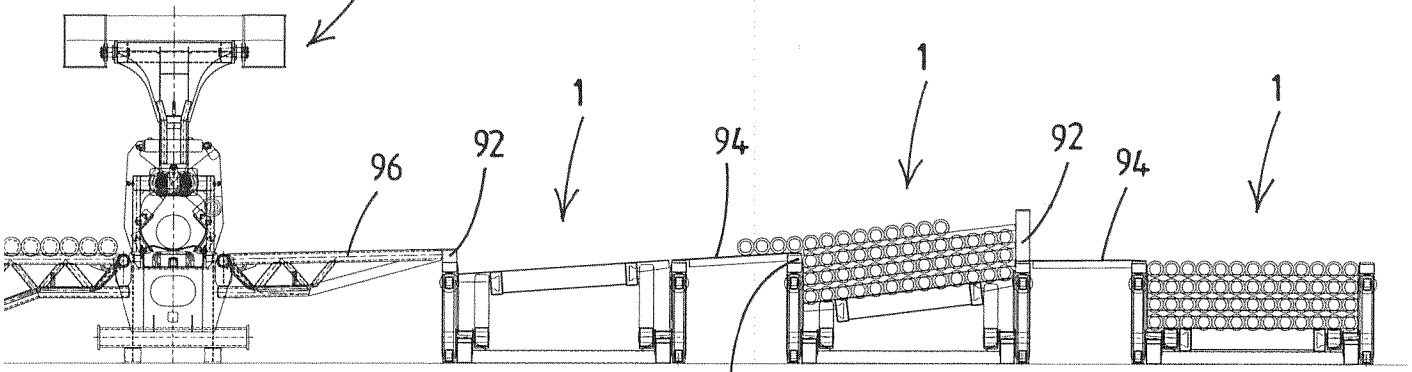
FIG. 6 shows the system of FIG. 5 with one well drilling tubulars bin being empty.
Figure 7:
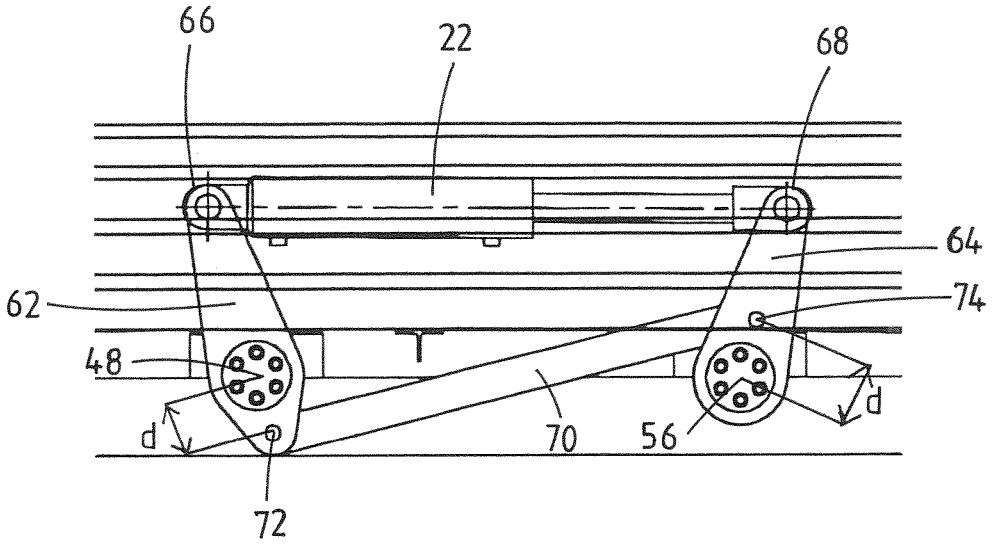
FIG. 7 shows a detail VII of FIG. 1.

The well drilling tubulars bin system of FIGS. 5 and 6 comprises three well drilling tubulars bins 1, and four slide bars 94 which are at their respective ends connectable to a top portion of the struts 92 of the well drilling tubulars bins 1 for providing a roll structure for well drilling tubulars 6 from one well drilling tubulars bin 1 to another well drilling tubulars bin 1. The slide bars 94 are preferably tilted by raising one of the respective struts 92 for each slide bar 94, as shown in FIG. 6. One of the well drilling tubulars bins 1 is connected via a transfer table 96 to the pipe loader 32. One end of the transfer table 96 remote from the pipe loader 32 is positioned on the struts 92 of the respective well drilling tubulars bin 1.

The invention claimed is:

1. Well drilling tubulars bin system, comprising a well drilling tubulars bin and control device, the well drilling tubulars bin comprising a frame structure and an elevator mechanism for holding and lifting multiple layers of well drilling tubulars, wherein the frame structure comprises a bottom frame, a left side frame fixed to the bottom frame, and a right side frame fixed to the bottom frame, the left side frame and the right side frame being of the same height, wherein the elevator mechanism comprises a liftable support structure, a left hydraulic cylinder, and a right hydraulic cylinder, wherein the liftable support structure defines a support plane for supporting the layers of well drilling tubulars, which support structure is liftable from a lower position wherein the support plane is below half the height of the side frames to an upper position wherein the support plane is at a height at least equal to a top part of one of the side frames, and wherein the control device is adapted to actuate the left and right hydraulic cylinder such that the liftable support structure is raised and lowered in a level manner, and for actuating the left and right hydraulic cylinder such that the liftable support structure obtains a tilt angle with respect to a horizontal plane towards one of the left and the right side frame, wherein the elevator mechanism further comprises a first left lift arm and a first right lift arm, said lift arms being rotatable in a vertical plane, preferably in a plane adjacent the inside of the respective left and right side frame, wherein the left hydraulic cylinder is connected to the first left lift arm for rotating the first left lift arm, and the right hydraulic cylinder is connected to the first right lift arm for rotating the first right lift arm, and wherein the first left lift arm at a first end is rotatably connected to the liftable support structure with a first left support structure pivot, and at a second end opposite from the first end is rotatably connected to the frame structure with a first left frame structure pivot, and the first right lift arm at a first end is rotatably connected to the liftable support structure with a first right support structure pivot, and at a second end opposite from the first end is rotatably connected to the frame structure with a first right frame structure pivot, such that actuation of the hydraulic cylinders causes rotation of the first left lift arm and the first right lift arm in order to lift, lower, or tilt the liftable support structure.

2. Well drilling tubulars bin system according to claim 1, wherein the first left support structure pivot and the first right support structure pivot each allow rotation about at least two different axis of rotation.

3. Well drilling tubulars bin system according to claim 1, wherein the first left support structure pivot and the first right support structure pivot each allow translational movement between the support structure and the respective first end of the first left lift arm, respectively first right lift arm.

4. Well drilling tubulars bin system according to claim 1, wherein the first left frame structure pivot and the first right frame structure pivot define each one rotational axis which is fixed with respect to the frame structure and to the respective lift arm.

5. Well drilling tubulars bin system according to claim 1, wherein the elevator mechanism further comprises a first left actuator arm which is fixedly connected to the first left lift arm for joint rotation of the first left actuator arm and the first left lift arm around the first left frame structure pivot, and the left hydraulic cylinder is connected to the first left lift arm via the first left actuator arm at an end of the first left actuator arm which is distal with respect to the first left frame structure pivot.

6. Well drilling tubulars bin system according to claim 5, wherein the first left actuator arm and the left hydraulic cylinder are provided in the left side frame.

7. Well drilling tubulars bin system according to claim 1, wherein the elevator mechanism ROM further comprises a second left lift arm, a second left actuator arm, and a second left frame structure pivot, wherein the second left actuator arm is fixedly connected to the second left lift arm for joint rotation around the second left frame structure pivot for lifting the liftable support structure, and the left hydraulic cylinder extends from the first end of the first left actuator arm to a first end of the second left actuator arm.

8. Well drilling tubulars bin system according to claim 7, wherein the elevator mechanism further comprises a left stabilising rod which extends from the first left actuator arm to the second left actuator arm, and the left stabilising rod is rotatably connected to the first left actuator arm at a point on the first left actuator arm located at a distance d from the first left frame structure pivot away from the first end of the first left actuator arm, and the left stabilising rod is rotatably connected to the second left actuator arm at a point on the second left actuator arm located at the same distance d from the second frame structure pivot towards the first end of the second left actuator arm.

9. Well drilling tubulars bin system according to claim 1, wherein the liftable support structure comprises a left longitudinal beam, a right longitudinal beam, and at least two cross beams, which at least cross beams extend between, and are connected to, the left and right longitudinal beams, and the left longitudinal beam is provided with the first left support structure pivot, and the right longitudinal beam is provided with the first right support structure pivot.

10. Well drilling tubulars bin system according to claim 1, further comprising at least two movable struts which are held in one of the left and right side frame, and which are movable from a retracted position wherein the at least two struts do not extend above the respective side frame to at least one raised position, wherein the at least two struts extend partly above the respective side frame.

11. Well drilling tubulars bin system comprising at least two well drilling tubulars bins according to claim 1, and at least two slide bars which are at their respective ends connectable to the at least two well drilling tubulars bins for providing a roll structure for well drilling tubulars from one well drilling tubulars bin to another well drilling tubulars bin.

12. Well drilling tubulars bin system according to claim 10, wherein the slide bars are connectable to a top portion of the struts.

13. Well drilling tubulars bin system according to claim 1, wherein at least part of the control device is located at a position remote from the well drilling tubulars bin, and wherein the control device preferably is electronically connected to the control unit of a drilling rig pipe loader.

14. Well drilling tubulars bin system according to claim 1, further comprising at least one weight sensor for determining the total weight of the well drilling tubulars in the well drilling tubulars bin.

15. Method for transporting and storing of well drilling tubulars, wherein use is made of a system according to claim 1.

16. Well drilling tubulars bin system according to claim 11, wherein the slide bars are connectable to a top portion of the struts.

* * * * *